United States Patent [19]

Kawashima et al.

[11] 4,197,122

[45] Apr. 8, 1980

[54] PROCESS FOR PREPARING RAW PARTICLES OF CADMIUM SULFIDE FOR ELECTROPHOTOGRAPHY

[75] Inventors: Hirokuni Kawashima, Tokyo; Kiyoshi Suzuki, Kawasaki, both of Japan

[73] Assignee: Canon Kabushiki Kaisha, Tokyo, Japan

[21] Appl. No.: 792,459

[22] Filed: Apr. 29, 1977

[51] Int. Cl.[2] ..... G03G 5/08; G03G 5/087

[52] U.S. Cl. ..... 430/94; 423/561 B; 423/566; 252/62.6; 430/95

[58] Field of Search ..... 96/1.5; 252/501; 423/561 B, 566

[56] References Cited

U.S. PATENT DOCUMENTS

| | | | |
|---|---|---|---|
| 2,916,678 | 12/1959 | Bube et al. | 252/501 |
| 3,647,430 | 3/1972 | Hanada et al. | 96/1.5 |
| 3,743,609 | 7/1973 | Hirata et al. | 252/501 |
| 3,754,985 | 8/1973 | Marlor et al. | 252/501 |

FOREIGN PATENT DOCUMENTS

| | | | |
|---|---|---|---|
| 632340 | 12/1961 | Canada | 423/561 B |

OTHER PUBLICATIONS

Sato, "Diffraction Crystallography of Precipitatant Cadmium Sulfide" Applied Physics-Japan, vol. 35, No. 6 (1966), pp. 388-392.

*Primary Examiner*—Roland E. Mattin, Jr.
*Attorney, Agent, or Firm*—Fitzpatrick, Cella, Harper & Scinto

[57] ABSTRACT

A process for preparing raw particles of cadmium sulfide for electrophotography comprises reacting a solution containing cadmium ion and hydrochloric acid with hydorgen sulfide to make cadmium sulfide particles deposited from the solution.

8 Claims, 1 Drawing Figure

PROCESS FOR PREPARING RAW PARTICLES OF CADMIUM SULFIDE FOR ELECTROPHOTOGRAPHY

BACKGROUND OF THE INVENTION

1. Field of the Invention

The present invention relates to a process for preparing raw particles of cadmium sulfide for electrophography.

2. Description of the Prior Art

A conventional process hitherto used for preparing raw particles of cadmium sulfide is to introduce hydrogen sulfide gas into a solution containing cadmium ion such as a solution of cadmium sulfate so as to deposit cadmium sulfide particles from the solution. The cadmium sulfide particles prepared by such a conventional process are raw particles for use in the preparation of final cadmium sulfide particles as a photoconductive material for electrophotography. To prepare the final cadmium sulfide particles for electrophotography, it is usually necessary to further treat the above-mentioned raw particles. Various treating methods have been known and used for this purpose. According to one typical treating method, an impurity having a sensitizing effect of the type so-called donor and acceptor is added to the raw particles and the mixture is heated to a high temperature ranging from 400° C. to 700° C. This treatment has the effect to diffuse the impurity into the raw particles and activate them so that sensitized cadmium sulfide particles may be formed. The sensitized cadmium sulfide particles thus obtained are used as a photoconductive material for electrophotography.

Another conventional method used for preparing raw particles of cadmium sulfide is to use a solution containing cadmium ion and ion of impurity element. This solution is reacted with hydrogen sulfide to form raw particles of cadmium sulfide that preliminarily contains impurity. Since the raw particles thus prepared have already contained the necessary impurity, it is allowed to obtain the aimed cadmium sulfide particles in which impurity is diffused i.e. the aimed sensitized particles by an after-treatment with heat, without incorporating any impurity at the treatment. Also, the sensitized cadmium sulfide particles can be used as a photoconductive material for electrophotography. The latter mentioned preparing method has the advantage that the heat treatment can be carried out at a relatively low temperature compared with the former since the necessary impurity has already been contained in the raw particles before the heat treatment. Furthermore, according to the latter method, a better efficiency is attainable in dispersing the impurity.

However, it has been found that these conventional processes have, in common, some drawbacks as to the preparation of the raw particles.

One of the important disadvantages is found in the fact that the final photoconductive cadmium sulfide particles for electrophotography do not exhibit the same and constant electric characteristic. As known to those skilled in the art, it is important that all of photoconductive cadmium sulfide particles for electrophotography obtained by treating raw particles prepared under the same preparing condition should exhibit the same and constant electrophotographic characteristic. This is an essential requirement to make the produce marketable. But, it is impossible to produce good product particles enough to satisfy the requirement according to the conventional processes as described above. In particular, the first mentioned conventional process can not satisfy it.

As another drawback of the conventional processes, it is pointed out that the final photoconductive cadmium sulfide particles for electrophotography obtained by the heat treatment of the raw particles prepared by the conventional processes are poor in moisture resisting property. They are apt to absorb atmospheric moisture and therefore the electrophotographic characteristic of the cadmium sulfide particles changes very easily in accordance with the change in atmospheric humidity. With such cadmium sulfide particles it is difficult to make a good electrophotographic photosensitive material stable against moisture.

SUMMARY OF THE INVENTION

Accordingly it is the principal object of the present invention to provide a novel process for preparing raw particles of cadmium sulfide which allows to solve the problems involved in the known processes as described above.

Another object of the invention is to provide cadmium sulfide particles sensitized to the light having a long wavelength.

In accordance with the present invention, there is provided a process for preparing raw particles of cadmium sulfide for electrophotography which comprises reacting a solution containing cadmium ion and hydrochloric acid with hydrogen sulfide to deposit cadmium sulfide particles from the solution.

Other and further objects, features and advantages of the invention will appear more fully from the following description.

BRIEF DESCRIPTION OF THE DRAWING

The single FIGURE is a graph showing the sensitivities of various electrophotographic photosensitive plates wherein the curves F and G are sensitivity curves of the photosensitive plates made by using raw particles of cadmium sulfide prepared according to the present invention whereas the curves F' and G' are obtained from the photosensitive plates made by using raw particles of cadmium sulfide prepared according to the conventional ones.

DESCRIPTION OF THE PREFERRED EMBODIMENTS

Figure 1:
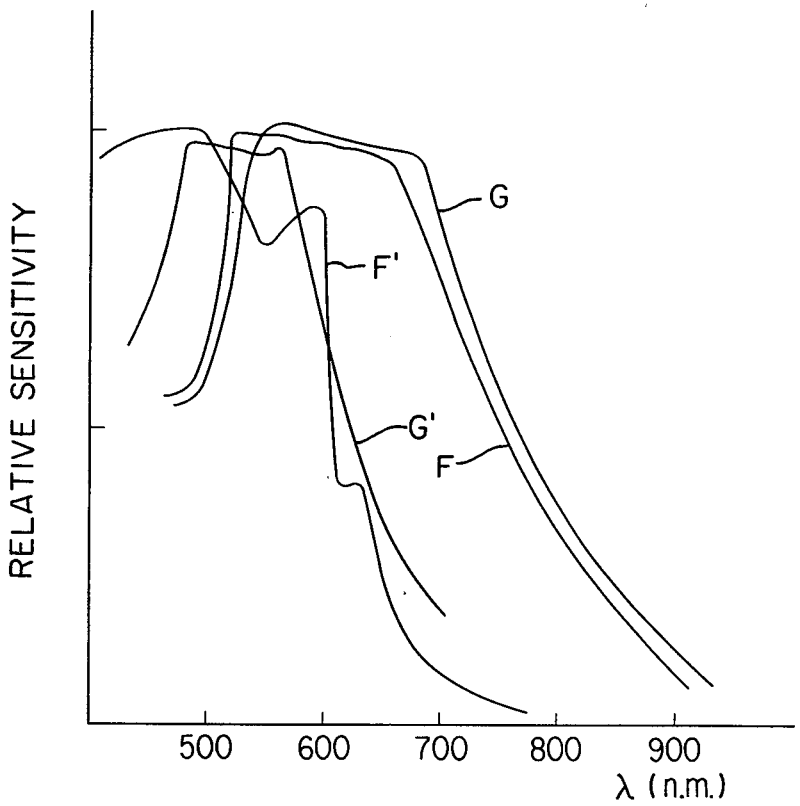

The aimed objects of the present invention are attained by depositing the particles of cadmium sulfide resulted from the reaction in the presence of hydrochloric acid. Hydrochloric acid used in the process of the invention contributes to the preparation of cadmium sulfide particles having constant and definite electric characteristic as well as excellent moisture resisting property. Furthermore, the presence of the hydrochloric acid enables to produce highly sensitized cadmium sulfide particles compared with the conventional ones.

As a solution containing cadmium ion, an aqueous solution of a water soluble salt of cadmium is generally used. Examples of water soluble cadmium salt include cadmium sulfate, cadmium chloride, cadmium nitrate, cadmium acetate, cadmium bromide, cadmium iodide and the like. When such a water soluble cadmium salt is dissolved in water, cadmium becomes present in the form of ion in the aqueous solution. As an alternative, the solution containing cadmium ion may be prepared by dissolving metallic cadmium in an acid solution capable of dissolving it.

The preparation of a solution containing cadmium ion and hydrochloric acid may be carried out either by adding hydrochloric acid to a solution containing cadmium ion or by adding cadmium ion to a solution containing hydrochloric acid. The reaction of the solution containing cadmium ion and hydrochloric acid with hydrogen sulfide can be carried out according to various known methods. The most typical method is to introduce gaseous hydrogen sulfide into the solution. Other methods such as adding a solution of hydrogen sulfide to the solution or adding the latter to the former may be employed for carrying out the reaction.

It is believed that the resultant product of the reaction of the solution containing cadmium ion and hydrochloric acid with hydrogen sulfide, i.e. raw particles of cadmium sulfide contain chlorine resulted from the used hydrochloric acid although the amount of the chlorine may be very small.

The raw particles of cadmium sulfide thus prepared are subjected to a heat treatment so as to make the particles usable as a photoconductive material for electrophotography. During the heat treatment, the raw particles are heated together with impurity element which serves as donor or acceptor, or with a suitable compound containing therein such an impurity element. As a result, the impurity element is diffused (doped) into the cadmium sulfide particles so that activated photoconductive material useful for electrophotography is obtained. As such an impurity element, there are two types of element one of which is called a donor impurity element and the other is an acceptor impurity element. The donor impurity element is generally selected from elements of Group III*a*, Group III*b* and Group VII*a* of the Periodic Table. Preferably Al, In, Ga, Sc and halogen such as Cl, Br and I are used which have a relatively shallow donor level. Here it should be noted that the impurity Cl mentioned above is one offered by substance other than hydrochloric acid. Preferable examples of the acceptor impurity element include elements of Group I of the Periodic Table such as Cu, Ag, Au and Li.

To add the impurity element to the raw particles of cadmium sulfide prior to the heat treatment, various procedures can be employed. For example, the impurity element itself may be mixed with the raw particles or a water soluble salt containing the impurity element may be mixed with the raw particles. As a water soluble salt suitable for this purpose, mention may be made of sulfate, nitrate and cyanate of the impurity element including the following examples: $Al_2(SO_4)_3$, $In_2(SO_4)_3$, $Ga_2(SO_4)_3$, $Sc_2(SO_4)_3$, CuCl, $CuCl_2$, $CuSO_4$, $AgNO_3$ and $Au(CN)_3.3H_2O$.

The amount of diffusion of impurity element affects the photoconductivity of cadmium sulfide. In case of the donor impurity element, the amount of diffusion is preferably in the range of $1\times10^{-4}-1\times10^{-2}$ mol per 1 mol of cadmium sulfide, and for the acceptor impurity element the range of $2\times10^{-5}-5\times10^{-3}$ mol is preferable.

The incorporation of impurity element into the cadmium sulfide may be carried out when the raw particles are prepared. In this case, raw particles containing impurity element can be prepared by reacting a solution containing cadmium ion, hydrochloric acid and impurity element with hydrogen sulfide. When the raw particles thus prepared is treated with heat, the aimed cadmium sulfide particles in which the impurity element is diffused, is obtained. Before the heat treatment, the impurity element contained in the raw particles is present in a state not yet diffused in the particles.

As impurity element used for preparing a solution containing cadmium ion, hydrochloric acid and impurity element, the impurity element itself or a water soluble salt thereof as mentioned above may be used.

For preparing cadmium sulfide particles in which impurity element is diffused, an additional amount of impurity element may be added to the raw particles that have already contained some amount of impurity element prior to a heat treatment.

The impurity element to be diffused in the cadmium sulfide particles may be either of the two types, donor and acceptor. Since the raw particles of cadmium sulfide according to the invention allow the impurity element to easily diffuse in the particles at the time of heat treatment, the heat treatment may be also carried out without adding any flux.

For the density of hydrochloric acid in the solution containing cadmium ion used in the preparation of raw material, a relatively low density is preferably used. Taking the particle size of raw particles into consideration, a range of from 0.01 N to 0.5 N is recommendable. Speaking of the average particle size, about $1-3\mu$ is a preferable range for it.

Now the invention will be explained more fully by examples and referential examples.

EXAMPLE 1

To 2 l of 2 N aqueous sulfuric acid containing 1 mol of cadmium sulfate, $4\times4^{-4}$ mol of copper sulfate and $2\times10^{-4}$ mol of indium sulfate, hydrochloric acid was added in such amount that the solution contains 0.02 N hydrochloric acid. After the addition, hydrogen sulfide was introduced to the solution at the rate of 1 l/min. for 60 minutes while keeping the temperature of the solution at 60° C. The resultant cadmium sulfide was washed with water and dried after removing excess of impurity. Then it was heated under a nitrogen atmosphere at 450° C. for 120 minutes. After the heat treatment, it was again washed with water and dried to obtain cadmium sulfide for electrophotography.

To the cadmium sulfide thus prepared, there was added 10% by weight (based on the weight of the cadmium sulfide) of vinyl chloride/vinyl acetate copolymer resin and thoroughly dispersed. Thereafter the resultant mixture was coated onto a support plate of aluminum so as to form a photoconductive layer $40\mu$ thick on the support and dried. In addition, a polyester film $25\mu$ thick was overlaid on the photoconductive layer to make a photosensitive plate.

Using the photosensitive plate, an image forming was carried out with a copying machine the basic process of which includes the steps of charging with positive polarity, image-wise exposure with simultaneous discharging and whole surface exposure. An image having a good sharpness and a high resolution was obtained.

Also, an image forming was carried out using the same photosensitive plate, but under the condition of high humidity. A clear image that was hardly affected by moisture was obtained.

To evaluate the moisture resisting property of the photosensitive material, the plate was allowed to stand over night under the moisture of 100% R.H. and then the moisture absorption of the photosensitive layer was measured according to the Karl Fischer's method. The moisture content in the layer was found to be 2100 ppm.

REFERENTIAL EXAMPLE 1

Cadmium sulfide was prepared in the same manner as described in Example 1 with the exception that hydrochloric acid was not added this time. Using the cadmium sulfide, a photosensitive plate was made in the same manner as described in Example 1 and an image was formed on it in accordance with the procedure described in Example 1. An image having a good sharpness was obtained. But when an image forming was carried out under the condition of high humidity, a reduction in image density was observed in the formed image. In the same manner as in Example 1, the moisture absorption of the photosensitive plate was measured. The moisture content was found to be 4800 ppm. This means that the moisture resisting property of this photosensitive plate was not so good.

EXAMPLE 2

To 2 l of 2 N aqueous sulfuric acid containing 1 mol of cadmium sulfate, $10\times4^{-4}$ mol of copper sulfate and $15\times10^{-4}$ mol of indium sulfate, hydrochloric acid was added in such amount that the solution contains 0.5 N hydrochloric acid. After the addition, hydrogen sulfide was introduced to the solution at the rate of 1 l/min. for 120 minutes while keeping the temperature of the solution at 40° C. The resultant cadmium sulfide was washed with water and dried after removing excess of impurity. Then it was heated under a nitrogen atmosphere at 450° C. for 120 minutes. After the heat treatment, it was again washed with water and dried to produce cadmium sulfide for electrophotography.

Using the cadmium sulfide thus prepared, a photosensitive plate was made and an image forming was carried out in the same manner as in Example 1. An image having a good sharpness and a high resolution was obtained. Also, when an image forming was carried out under the condition of high humidity, there was produced an image having an excellent sharpness which was hardly affected by moisture. The photosensitive plate was allowed to stand in the moisture of 100% R.H. over night and then the moisture absorption of the photosensitive layer was measured. The moisture content in the layer was found to be 1500 ppm.

REFERENTIAL EXAMPLE 2

Cadmium sulfide was prepared in the same manner as described in Example 2 with the exception that hydrochloric acid was not added this time. Using the cadmium sulfide, a photoconductive plate was made in the same manner as described in Example 1 and an image was formed on it according to the procedure described in Example 1. An image having a good sharpness was obtained. But when an image forming was carried out under the condition of high humidity, a reduction in image density was observed in the formed image. In the same manner as in Example 1, the moisture absorption of the photosensitive plate was measured. The moisture content was found to be 4500 ppm. This means that the moisture resisting property of this photosensitive plate was not so good.

EXAMPLE 3

To 2 l of 2 N aqueous sulfuric acid containing 1 mol of cadmium sulfate, $8\times4^{-4}$ mol of copper sulfate and $10\times10^{-4}$ mol of indium sulfate, hydrochloric acid was added in such amount that the solution contains 0.3 N hydrochloric acid. After the addition, hydrogen sulfide was introduced to the solution at the rate of 1 l/min. for 120 minutes while keeping the temperature of the solution at 50° C. The resultant cadmium sulfide was washed with water and dried after removing excess of impurity. Then it was heated under a nitrogen atmosphere at 450° C. for 120 minutes. After the heat treatment, it was again washed with water and dried to produce cadmium sulfide for electrophotography.

Using the cadmium sulfide thus prepared, a photosensitive plate was made and an image forming was carried out in the same manner as in Example 1. An image having a good sharpness and a high resolution was obtained. Also, when an image forming was carried out under the condition of high humidity, there was produced an image having an excellent sharpness which was hardly affected by moisture. The photosensitive plate was allowed to stand in the moisture of 100% R.H. over night and then the moisture absorption of the photosensitive layer was measured. The moisture content in the layer was found to be 1900 ppm.

REFERENTIAL EXAMPLE 3

Cadmium sulfide was prepared in the same manner as described in Example 3 with the exception that hydrochloric acid was not added this time. Using the cadmium sulfide, a photosensitive plate was made in the same manner as described in Example 1 and an image was formed on it according to the procedure described in Example 1. An image having a good sharpness was obtained. But when an image forming was carried out under the condition of high humidity, a reduction in image density was observed in the formed image. In the same manner as in Example 1, the moisture absorption of the photosensitive plate was measured. The moisture content was found to be 4500 ppm. This means that the moisture resisting property of this photosensitive plate was not so good.

EXAMPLE 4

An aqueous sulfuric acid was prepared so as to contain 1 mol of cadmium sulfate, $10\times10^{-4}$ mol of copper sulfate and $15\times10^{-4}$ mol indium sulfate and to have 0.3 N hydrochloric acid in it. To 2 l of the solution, there was introduced hydrogen sulfide at the rate of 1 l/min. for 60 minutes. The resultant cadmium sulfide was washed with water and dried after removing excess of impurity. Then the product was heated in a nitrogen atmosphere at the temperature of 450° C. for 120 minutes. After the heat treatment, it was again washed with water and dried. Thus cadmium sulfide for electrophotography was prepared.

The above described process for the preparation of cadmium sulfide was repeated five times in the entirely same manner so that five samples of cadmium sulfide were obtained each of which corresponds to each run of the five processes respectively.

To each of the five samples of cadmium sulfide thus prepared, 10% by weight of vinyl chloride/vinyl acetate copolymer resin was added and uniformly dispersed. The resultant mixture was coated onto a support plate of aluminum to form a photoconductive layer 40μ thick on the support and dried. Thereafter, a polyester film 25μ thick was overlaid on the photoconductive layer to make a photosensitive plate.

In this manner, the following five photosensitive plates A through E were manufactured:

Photosensitive Plate A=photosensitive plate manufactured by using cadmium sulfide prepared by the first run process.

Photosensitive Plate B=photosensitive plate manufactured by using cadmium sulfide prepared by the second run process.

Photosensitive Plate C=photosensitive plate manufactured by using cadmium sulfide prepared by the third run process.

Photosensitive Plate D=photosensitive plate manufactured by using cadmium sulfide prepared by the fourth run process.

Photosensitive Plate E=photosensitive plate manufactured by using cadmium sulfide prepared by the fifth run process.

A voltage was applied to each the photosensitive plates with an electrode and the voltage then applied to the photoconductive layer was measured. When ⊕2000 V and ⊖2000 V were applied, the voltages measured at the respective photoconductive layer were as follows:

| Photosensitive Plate | | Applied Voltage | |
|---|---|---|---|
| | | ⊕ 2000 V | ⊖ 2000 V |
| Voltage at Photoconductive layer | A | 320 V | − 1000 V |
| | B | 270 v | − 980 V |
| | C | 300 V | − 1030 V |
| | D | 310 V | − 1050 V |
| | E | 250 V | − 11 950 V |

From the above table, it will be understood that cadmium sulfide prepared according to the invention exhibits almost the same and constant characteristic through all the runs and the irregularity in characteristic is very small.

REFERENTIAL EXAMPLE 4

Into a 2 N aqueous sulfuric acid containing 1 mol of cadmium sulfate, a gaseous stream of hydrogen sulfide was introduced at the rate of 1 l/min. As the product of the reaction, cadmium sulfide was precipitated. After washing the precipitate with water and drying it, completely, $10\times10^{-4}$ mol of copper sulfate and 2% by weight (based on the weight of cadmium sulfide) of cadmium chloride serving as flux were added and mixed with the cadmium sulfide to form a homogeneous mixture. The mixture was then fired at the temperature of 450° C. After the firing it was again washed with water and dried. Thus cadmium sulfide for electrophotography was prepared.

The above described process for the manufacture of cadmium sulfide was repeated five times in the entirely same manner so that five samples of cadmium sulfide were obtained each of which corresponds to each run of the five processes respectively.

Using these samples of cadmium sulfide, the following five photosensitive plates A' through E' were manufactured in the same manner as described in Example 4:

Photosensitive Plate A'=photosensitive plate manufactured by using cadmium sulfide prepared by the first run process.

Photosensitive Plate B'=photosensitive plate manufactured by using cadmium sulfide prepared by the second run process.

Photosensitive Plate C'=photosensitive plate manufactured by using cadmium sulfide prepared by the third run process.

Photosensitive Plate D'=photosensitive plate manufactured by using cadmium sulfide prepared by the fourth run process.

Photosensitive Plate E'=photosensitive plate manufactured by using cadmium sulfide prepared by the fifth run process.

A voltage was applied to each the photosensitive plates with an electrode and the voltage then applied to the photoconductive layer was measured. When ⊕2000 V and ⊖2000 V were applied, the voltages measured at the respective photoconductive layer were as follows:

| Photosensitive Plate | | Applied Voltage | |
|---|---|---|---|
| | | ⊕ 2000 V | ⊖ 2000 V |
| Voltage at Photoconductive layer | A' | 400 V | − 1000 V |
| | B' | 250 V | − 800 V |
| | C' | 500 V | − 1100 V |
| | D' | 300 V | − 900 V |
| | E' | 310 V | − 8500 V |

From the above table, it will be understood that cadmium sulfide prepared above has a large irregularity in characteristic each other through the five runs.

EXAMPLE 5

In the same manner as that of Example 4, but using this time a 2 N aqueous sulfuric acid so prepared as to contain 1 mol of cadmium sulfate, $4\times10^{-4}$ mol of copper sulfate and $10\times10^{-4}$ mol of indium sulfate, and to have 0.3 N hydrochloric acid contained in it, a photosensitive plate F was manufactured.

Also, in the same manner as in Example 4, a photosensitive plate G was manufactured. But, this time there was used a 2 N aqueous sulfuric acid containing 1 mol of cadmium sulfate, $6\times10^{-4}$ mol of copper sulfate and $12\times10^{-4}$ mol of indium sulfate and having 0.5 N hydrochloric acid contained therein.

These photosensitive plates F and G were passed to the process of electrophotography as described in Example 1 to evaluate the sensitivity of the plates. From the measurement of sensitivity, the curve F of FIG. 1 was obtained from the photosensitive plate F and the curve G from the plate G. These curves show that the photosensitive plates F and G exhibit a good sensitivity also to the light in the range of long wave length.

REFERENTIAL EXAMPLE 5

To 1 mol of cadmium sulfide prepared by introducing hydrogen sulfide to cadmium sulfate, $2\times10^{-4}$ mol of copper chloride and 2% by weight (based on the weight of cadmium sulfide) of cadmium chloride were added and thoroughly mixed to form a homogeneous mixture. Then the mixture was fired at 450° C. for 100 minutes. The fired mixture was washed with water and dried. Thus cadmium sulfide for electrophotography was obtained. In the same manner as in Example 4, a photosensitive plate F' was manufactured by using the cadmium sulfide.

Also a photosensitive plate G' was manufactured by using cadmium sulfide which was prepared as follows:

To 1 mol of cadmium sulfide prepared by introducing hydrogen sulfide to cadmium sulfate, $6\times10^{-4}$ mol of copper chloride and 2% by weight (based on the weight of cadmium sulfide) of cadmium chloride were added and mixed to form a homogeneous mixture. The mixture was fired at 450° C. for 100 minutes. Washed with water and dried, the fired mixture gave the aimed cadmium sulfide.

These photosensitive plates F' and G' were tested to evaluate their sensitivity in the same manner as in Example 5. The sensitivity curves F' and G' shown in FIG. 1 were obtained from the photosensitive plates F' and G' respectively.

These curves show that the sensitivities of the photosensitive plates F' and G' are inferior to those of the photosensitive plates F and G according to the invention.

EXAMPLE 6

2 l of a 2 N aqueous sulfuric acid was prepared which contained $4\times10^{-4}$ mol of Cu and $4\times10^{-4}$ mol of In per 1 mol of cadmium sulfate. As Cu and In, the corresponding sulfates were used. To the solution thus prepared, hydrochloric acid was added in such amount that the solution contained 0.02 N hydrochloric acid therein. After the addition, the temperature of the solution was raised up to 60° C. and hydrogen sulfide was introduced into the solution at the flow rate of 1 l/min. for 60 minutes. The resultant cadmium sulfide from the reaction mixture was washed with water and dried after removing excess of impurity. Then the cadmium sulfide was treated with heat in a nitrogen atmosphere at 450° C. for 120 minutes. After the heat treatment, the product was again washed with water and dried. Thus cadmium sulfide having 2.0μ of particle size was obtained.

The cadmium sulfide was dispersed into a vinylchloride vinylacetate copolymer and the dispersion was coated onto a support plate of aluminum to form a photoconductive layer 40μ thick on the support. After drying the coating, a polyester film 25μ thick was overlaid on the photoconductive layer to make a photosensitive plate.

Using the photosensitive plate composed of three layers an image forming was carried out through an electrophotographic process comprising the steps of charging, imagewise exposure with simultaneous discharging and whole surface exposure. An image having a good sharpness and a high resolution was obtained.

EXAMPLES 7–13

The process and procedure of Example 6 were repeated under various different conditions. Data of starting materials, final products and reaction conditions used for these examples are summarized in the table given below.

| | Starting materials | | | Reaction conditions | | Firing conditions | | Final Product |
|---|---|---|---|---|---|---|---|---|
| Example No. | Donor ($\times 10^{-4}$mol) | Acceptor ($\times 10^{-4}$mol) | HCl density (N) | Temp. (°C.) | Time (min.) | Temp. (°C.) | Time (min.) | Particle size (μ) |
| 7 | In 15 | Cu 10 | 0.5 | 25 | 120 | 450 | 120 | 1.5 |
| 8 | Ga 10 | Cu 6 | 0.1 | 25 | 120 | 480 | 120 | 1.2 |
| 9 | In 8 | Au 6 | 0.1 | 80 | 60 | 420 | 120 | 3.0 |
| 10 | In 6 | Cu 4 | 0.005 | 80 | 60 | 450 | 120 | 2.0 |
| 11 | In 10 | Ag 5 | 0.1 | 60 | 120 | 500 | 120 | 2.5 |
| 12 | Al 20 | Cu 8 | 0.3 | 40 | 100 | 450 | 120 | 2.0 |
| 13 | Sc 10 | Cu 6 | 0.1 | 60 | 60 | 450 | 120 | 2.0 |

EXAMPLE 14

2 l of a 2 N aqueous sulfuric acid was prepared which contained $6\times10^{-4}$ mol of In per 1 mol of cadmium sulfate. To the solution, hydrochloric acid was added in such amount that the solution contained 0.1 N hydrochloric acid therein. After the addition, the temperature of the solution was raised up to 60° C. and hydrogen sulfide was introduced into the solution at the flow rate of 1 l/min. for 60 minutes. The resultant cadmium sulfide from the reaction mixture was washed with water and dried after removing excess of impurity. After having added $4\times10^{-4}$ mol of Cu and mixed completely, the cadmium sulfide was treated with heat for firing in a nitrogen atmosphere at 450° C. for 120 minutes. After the firing the product was again washed with water and dried. Thus cadmium sulfide having 2.5μ of the particle size was obtained.

Using the cadmium sulfide thus prepared, a photosensitive plate was manufactured and an image forming was carried out in the same procedure as in Example 6. A clear image was obtained.

EXAMPLES 15–18

According to the process of Example 14 where an acceptor impurity was added to cadmium sulfide at the time of firing, four samples of cadmium sulfide were prepared as shown in the following table. Also, using these samples of cadmium sulfide, the excellent results similar to that of Example 6 were obtained.

| | Starting materials | | Reaction conditions | | Firing conditions | | | Final product |
|---|---|---|---|---|---|---|---|---|
| Example No. | Donor ($\times 10^{-4}$mol) | HCl density (N) | Temp. (°C.) | Time (min.) | Acceptor ($\times 10^{-4}$mol) | Temp. (°C.) | Time (min.) | Particle size (μ) |
| 15 | In 10 | 0.1 | 40 | 120 | Cu 6 | 450 | 120 | 3.0 |
| 16 | In 8 | 0.5 | 25 | 120 | Ag 6 | 500 | 120 | 2.0 |
| 17 | Ga 10 | 0.01 | 80 | 60 | Cu 6 | 450 | 120 | 2.5 |
| 18 | Al 30 | 0.3 | 60 | 60 | Cu 10 | 450 | 120 | 3.0 |

EXAMPLE 19

To a 2 N aqueous sulfuric acid containing cadmium sulfate dissolved therein, 0.1 N hydrochloric acid was added and at the room temperature (25° C.) hydrogen sulfide was introduced to the solution at the flow rate of 1 l/min. for 120 minutes. A yellow precipitation of cadmium sulfide was obtained.

After washing the cadmium sulfide with water and making it dry, $6\times10^{-4}$ mol of In and $4\times10^{-4}$ mol of Cu were added to it. Thereafter, the product was fired in a nitrogen atmosphere at the temperature of 450° C. for 120 minutes. Cadmium sulfide having about 2.0μ of particle size was obtained. Using the cadmium sulfide thus obtained, a photosensitive plate was made according to the procedure as described in Example 6 and an image forming was carried out through the same electrophotographic process as that in Example 6. An image having an excellent sharpness and a high resolution was obtained.

EXAMPLES 20–23

According to the process of Example 19 where both of donor impurity and acceptor impurity were added to cadmium sulfide at the time of firing, four samples of cadmium sulfide were prepared as shown in the following table. Also, using these samples of cadmium sulfide, excellent results similar to that of Example 6 were obtained.

| Example No. | HCl density (N) | Reaction conditions Temp. (°C.) | Reaction conditions Time (min.) | Firing conditions Donor ($\times 10^{-4}$mol) | Firing conditions Acceptor ($\times 10^{-4}$mol) | Firing conditions Temp. (°C.) | Firing conditions Time (min.) | Final product particle size (μ) |
|---|---|---|---|---|---|---|---|---|
| 20 | 0.4 | 35 | 130 | In 20 | Cu 8 | 450 | 90 | 1 |
| 21 | 0.2 | 65 | 130 | Al 30 | Ag 10 | 450 | 90 | 3 |
| 22 | 0.06 | 45 | 130 | Ga 10 | Ag 6 | 450 | 90 | 1 |
| 23 | 0.02 | 75 | 130 | In 6 | Cu 6 | 450 | 90 | 2 |

What we claim is:

1. A process for preparing raw particles of cadmium sulfide for electrophotography which comprises reacting a solution containing cadmium sulfate and added hydrochloric acid with hydrogen sulfide to deposit cadmium sulfide particles from the solution.

2. A process for preparing raw particles of cadmium sulfide for electrophotography as claimed in claim 1, wherein said solution further contains at least one impurity element ion selected from the group consisting of a donor impurity and an acceptor impurity.

3. A process for preparing raw particles of cadmium sulfide for electrophotography as claimed in claim 2 wherein said impurity element ion is an ion of an element selected from the group consisting of In, Al, Ga, Sc, Cl, Cu, Au and Ag.

4. A process for preparing raw particles of cadmium sulfide for electrophotography as claimed in claim 1 wherein said solution is an aqueous sulfuric acid solution of metallic cadmium.

5. A process for preparing raw particles of cadmium sulfide for electrophotography as claimed in claim 2 wherein said donor impurity element is an element selected from the group consisting of the elements of Groups III*a*, III*b* and VII*a* of the Periodic Table, and wherein said acceptor impurity is an element selected from the group consisting of the elements of Group I of the Periodic Table.

6. In a process for preparing raw particles of cadmium sulfide for electrophotography which comprises reacting hydrogen sulfide with cadmium sulfate by passing hydrogen sulfide gas through an aqueous solution of cadmium sulfate to deposit cadmium sulfide particles from the solution, the improvement comprising using as said aqueous solution an aqueous solution comprising said cadmium sulfate in the presence of excess sulfuric acid and added hydrochloric acid in a concentration of from 0.01 to 0.5 N.

7. A process for preparing raw particles of cadmium sulfide for electrophotography as claimed in claim 6 wherein said aqueous solution further contains at least one impurity ion selected from the group consisting of a donor impurity and an acceptor impurity.

8. A process for preparing raw particles of cadmium sulfide for electrophotography as claimed in claim 7 wherein said impurity element ion is an ion of an element selected from the group consisting of In, Al, Ga, Sc, Cl, Cu, Au and Ag.

* * * * *